United States Patent [19]

Brandis et al.

[11] Patent Number: 4,783,436

[45] Date of Patent: Nov. 8, 1988

[54] CARRIER MATERIAL FOR CATALYSTS METHOD FOR PRODUCING IT AND PLATINUM GROUP METAL CATALYST SUPPORTED ON THE CARRIER

[76] Inventors: Helmut Brandis, Forstwaldstr. 694; Günter Lehnert, Breitendyk 145 b; Peter Schüler, Forstwaldstr. 707, all of 4150 Krefeld, Fed. Rep. of Germany

[21] Appl. No.: 74,061

[22] Filed: Jul. 16, 1987

[30] Foreign Application Priority Data

Jul. 26, 1987 [DE] Fed. Rep. of Germany ..... 3625330

[51] Int. Cl.[4] ..... B01J 21/04; B01J 23/89; B01J 32/00

[52] U.S. Cl. ..... 502/327; 502/439; 502/527; 423/213.5

[58] Field of Search ..... 502/439, 527, 327; 423/213.5

[56] References Cited

U.S. PATENT DOCUMENTS

| | | | |
|---|---|---|---|
| 3,873,472 | 3/1975 | Oshima et al. | 423/213.5 X |
| 3,925,259 | 12/1975 | Kane | 502/315 |
| 4,188,309 | 2/1980 | Völker et al. | 502/527 X |
| 4,318,828 | 3/1982 | Chapman | 502/527 X |

*Primary Examiner*—W. J. Shine

*Attorney, Agent, or Firm*—Cushman, Darby & Cushman

[57] ABSTRACT

The invention relates to a semi-finished product for the production of catalysts, consisting of a metallic carrier and a coating of the carrier on its surface. The coating consists of particles of metallic powder anchored to the material of the carrier and to each other by sintering and contains pores. The invention also provides a method of producing a metallic carrier with a coating for the anchoring of the reactive oxide layer or of the catalytically acting material.

7 Claims, 1 Drawing Sheet

CARRIER MATERIAL
ALSICHROM 2+CER.

IMMERSION COATING 56% FeAl+37% Shellac+7% Polyacrylic Resin

50:1

HEAT TREATMENT
950 °C 15 MIN. $H_2$
+900 °C 1 MIN. $CO_2$
+925 °C 16 h AIR 10,000:1

PRIMARILY
$Al_2O_3$-WHISKERS 10,000:1

IRON OXIDE-PLATES
ADJACENT TO
$Al_2O_3$-WHISKERS

CARRIER MATERIAL FOR CATALYSTS METHOD FOR PRODUCING IT AND PLATINUM GROUP METAL CATALYST SUPPORTED ON THE CARRIER

The present invention relates to a semi-finished product or carrier for the production of catalysts, consisting of a metallic base and a catalyst-supporting sintered metallic coating on its surface as well as a method of producing this carrier.

BACKGROUND OF THE INVENTION

Catalysts are used, inter alia, for the oxidation of incompletely burned exhaust gas constituents, for example in the exhaust from internal combustion engines, as well as for the reduction of nitrogen oxides in such exhaust gases. The catalysts are made by depositing catalytically active components on a coating which in turn is deposited on a carrier material.

Platinum group metals, for example, are used as catalytically active components in such catalysts.

The coating is formulated to provide the largest possible active surface area. The large surface area necessary for receiving the catalytically active components is produced, according to the state of the art, with a metallic oxide, e.g., in the form of gamma $Al_2O_3$, (see published German Specification DE-OS No. 32 23 500). It is also known that oxide whiskers can be formed on smooth metallic carrier foils which form an enlarged surface for anchoring an oxidic intermediary layer on which the catalytically active component is deposited (see British Pat. No. 2,062,723).

However, the known catalyst systems are relatively expensive. The cultivation of the whiskers requires special techniques during casting for a rapid hardening, in order to seed column crystals, and also requires a subsequent annealing in order to allow the columns to grow. These methods also require appropriate supports on the surface of which column crystals can be generated, such as Fe-Al-Cr alloys.

SUMMARY OF THE INVENTION

The object of the present invention is to create a semi-finished product or carrier in a flat form or with any desired profile for the production of catalysts which is produced in a simple manner, exhibits as large a surface as possible for subsequent adhesion of other layers and can be economically mass-produced.

More specifically, the present invention provides a semi-finished product or carrier for the production of catalysts, consisting of a metallic base and a sintered metallic coating on its surface, characterized in that the coating (2) consists of particles of metallic powder anchored to the material of the base (1) and to each other by sintering, and further characterized in that the coating contains pores (3).

The semi-finished product or carrier of the invention is produced by first mixing a substance which is volatile at elevated temperatures, preferably in powder form, into the metallic powder. Then the mixture, which may be in solid form or a paste, is applied onto the surface of a metallic base material and heated to a temperature sufficient to sinter the particles in the metal powder. The volatile substance evaporates without a residue and the metallic powder particles are bound to each other and to the base. Thereafter, the coating exhibits microscopic and macroscopic pores. In order to improve adhesion during application of the metallic powder to the metallic base, a temporary binder, for example a solution of a synthetic resin and/or shellac, or any other conventional adhesive material, can also be added to the metallic powder.

If the metallic powder particles contain aluminum or if the coating is calorized, aluminum oxide whiskers can be generated by an oxidizing annealing treatment. In a preferred embodiment of the invention the coating consists of FeAl. With this material, iron oxide platelets and aluminum oxide whiskers can be generated by an oxidizing annealing step which assures a considerable enlargement of the surface of the coating.

The advantage of the invention resides first of all in the considerably improved adhesion of the porous metallic layer to the base and secondly in the formation of a considerably enlarged surface of the coating on which the catalytically active component can be deposited in an optimum manner. Moreover, the base can be coated with the metallic powder in a simple manner by applying a paste, followed directly by drying thereof, sintering and depositing of the catalytically active material. If required, an oxidic annealing step may be employed after sintering. These successive method steps can be performed in a practical manner during a single passage of the metallic base material past successive processing stations.

The semi-finished product or carrier of the present invention may be impregnated with a solution of a platinum group metal, for example platinum or irridium, in conventional manner, to produce a catalyst useful, e.g., for the purposes described above.

BRIEF DESCRIPTION OF FIGURES OF DRAWING

In the drawing,

FIGS. 1, 2 and 3 are enlarged photographs of the products, as described in more detail below.

DETAILED DESCRIPTION OF PREFERRED EMBODIMENTS

The invention now will be described in more detail by means of the following illustrative example.

EXAMPLE 1

A metallic foil as base for the production of a structurally reinforced, honeycomb-like catalyst body consists of a Fe-20Cr-5Al alloy. The foil is coated with a paste consisting of 56% by weight FeAl, 37% by weight saturated alcoholic shellac solution and 7% by weight evaporable polyacrylic resin.

The FeAl powder used consists of approximately 50% Fe and 50% Al and is present in a particle size distribution between 36 and 45 μm. The shellac solution functions as binder during application. The evaporable polyacrylic resin is added in the form of fine powder.

Figure 1:
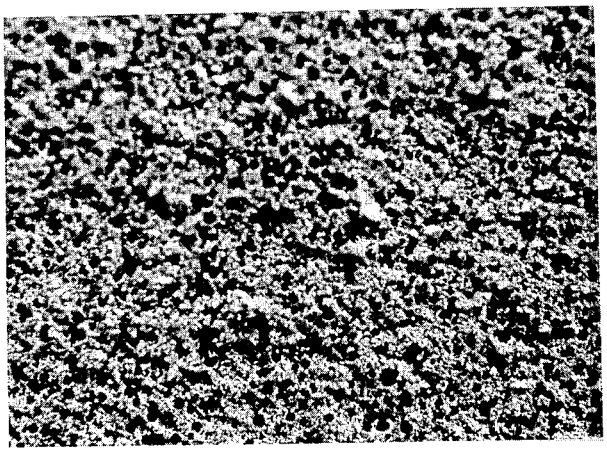

The alcoholic component of the shellac solution volatilizes in a short time in air, after the application of the paste onto the metallic carrier. Subsequently, the metallic base and the coating layer are heated at approximately 8° C./minute to 950° C. in a reducing atmosphere of protective gas, e.g. $H_2$, and maintained at that temperature for approximately 15 min. During the heating, both shellac and polyacrylic resin escape at temperatures below 650° C. in a gaseous form from the coating without leaving residues. Macroscopic pores are formed in an even distribution in the layer, due to the escape of the polyacrylic resin, in addition to finer hollow spaces between the particles of metallic powder (see FIG. 1). A further heating to 950° C. and maintaining at this temperature causes the particles of metallic powder to sinter to each other and to the carrier.

The entire process can also be accomplished by means of immersion coating on the finished structural body. If the metallic base foil is to be coated prior to the finishing of the structural body, e.g. on the band, the forming of the coated base foil is performed with advantage after the paste has dried in the air.

Figure 2:
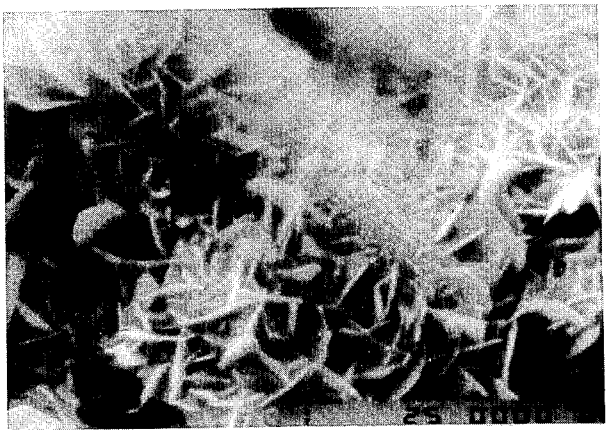
Figure 3:
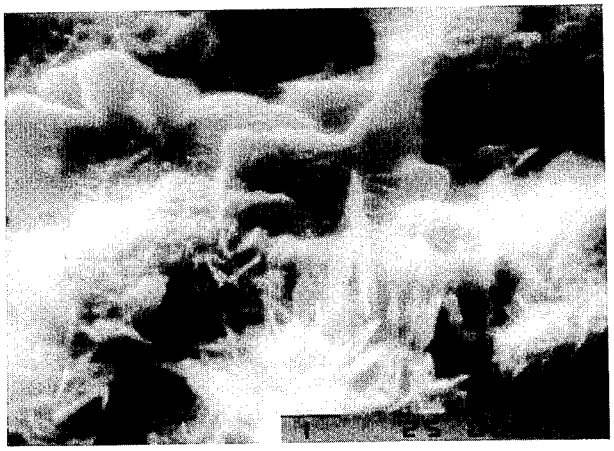

On account of its large surface, the sintered metallic coating layer, permeated with macropores and micropores, can be directly provided with, e.g., deposits of platinum metal. However, it can also be subjected to a whisker annealing, e.g. at 900° C. for 1 min. in dry $CO_2$ and at 925° C. for 16 hours in air in order to further enlarge the surface. This causes thin oxide needles of $Al_2O_3$ to grow (see FIG. 2) as well as fine iron oxide platelets on the individual metallic particles (see FIG. 3) when e.g. FeAl is used.

When aluminum-free metallic powders, e.g. FeCr, are used, the porous metallic coating layer can be enriched by diffusion with Al (e.g. CVD method).

Finally, the porous metallic coating can also serve to receive a reactive oxide layer in order to decisively improve its adhesion to the carrier material.

What is claimed is:

1. A method of producing a carrier for catalyst, the carrier having a metallic base and a sintered metallic coating for supporting a reactive oxide layer or a catalytically acting material, the method comprising (1) forming a coating mixture by compounding a metallic powder consisting essentially of FeAl with a volatile powdered substance which evaporates without a residue at an elevated temperature to form macroscopic pores in the sintered metallic coating, (2) coating a metallic base with said coating mixture, and (3) heating the coated carrier to solid-phase sintering temperature.

2. A method according to claim 1 in which an adhesive is added to said coating mixture.

3. A method according to claim 2 in which said coating mixture comprises an alcoholic paste containing the metallic powder, the volatile powdered substance and the adhesive.

4. A method according to claim 2 in which the adhesive is a synthetic resin or shellac.

5. A method according to claim 3 in which the adhesive is a synthetic resin or shellac.

6. A method according to claim 1 in which the coating is subjected to an oxidizing annealing.

7. A catalyst for the treatment of exhaust gases from internal combustion engines produced according to the method of any one of claims 1–5 or 6 impregnated or coated with a catalytically active platinum group metal.

* * * * *